United States Patent [19]

Shirai et al.

[11] Patent Number: 4,818,652

[45] Date of Patent: Apr. 4, 1989

[54] LIGHT RECEIVING MEMBER WITH FIRST LAYER OF A-SI(H,X) AND SECOND LAYER OF A-SIC(HX) WHEREIN FIRST AND SECOND LAYERS RESPECTIVELY HAVE UNEVENLY AND EVENLY DISTRIBUTED CONDUCTIVITY CONTROLLER

[75] Inventors: Shigeru Shirai, Shiga; Shigeru Ohno, Kanagawa, both of Japan

[73] Assignee: Canon Kabushiki Kaisha, Tokyo, Japan

[21] Appl. No.: 11,334

[22] Filed: Feb. 5, 1987

[30] Foreign Application Priority Data

| | | | |
|---|---|---|---|
| Feb. 7, 1986 | [JP] | Japan | 61-23689 |
| Feb. 7, 1986 | [JP] | Japan | 61-23690 |
| Feb. 13, 1986 | [JP] | Japan | 61-27899 |

[51] Int. Cl.[4] ..... G03G 5/085

[52] U.S. Cl. ..... 430/57; 430/85; 430/94

[58] Field of Search ..... 430/57, 85, 94

[56] References Cited

U.S. PATENT DOCUMENTS

| | | | |
|---|---|---|---|
| 4,663,258 | 5/1987 | Pai et al. | 430/66 |
| 4,666,807 | 5/1987 | Saitoh et al. | 430/66 |

*Primary Examiner*—John L. Goodrow

*Attorney, Agent, or Firm*—Fitzpatrick, Cella, Harper & Scinto

[57] ABSTRACT

There is provided an improved light receiving member comprising a substrate and a light receiving layer formed by laminating a first layer having photoconductivity which is constituted with an amorphous material containing silicon atoms as the main constituent atoms, and a second layer constituted with an amorphous material containing silicon atoms as the main constituent atoms and carbons atoms, the first layer containing an element for controlling the conductivity in unevenly distributed state, the second layer containing an element for controlling the conductivity in uniformly distributed state. The first layer may contain germanium atoms in an uniformly distributed state in the entire layer region or in the partial layer region adjacent to the substrate.

11 Claims, 9 Drawing Sheets

LIGHT RECEIVING MEMBER WITH FIRST LAYER OF A-SI(H,X) AND SECOND LAYER OF A-SIC(HX) WHEREIN FIRST AND SECOND LAYERS RESPECTIVELY HAVE UNEVENLY AND EVENLY DISTRIBUTED CONDUCTIVITY CONTROLLER

FIELD OF THE INVENTION

This invention relates to an improved light receiving member sensitive to electromagnetic waves such as light such as ultra-violet rays, visible rays, infrared rays, X-rays and γ-rays).

BACKGROUND OF THE INVENTION

For the photoconductive material to constitute an image-forming member for use in solid image pickup device or electrophotography, or to constitute a photoconductive layer for use in image-reading photosensor, it is required to be highly sensitive, to have a high S/N ratio (photocurrent (Ip)/dark current (Id)), to have absorption spectrum characteristics suited for the electromagnetic wave to be irradiated, to be quickly responsive and to have a desired dark resistance. It is also required to be not harmful to living things, especially man, upon use.

Other than those requirements, it is required to have a property of removing a residual image within a predetermined period of time in solid image pickup device.

Particularly for image-forming members used in an electrophotographic machine which is used as a business machine at the office, causing no pollution is highly important.

From these standpoints, the public attention has been focused on light receiving members comprising amorphous materials containing silicon atoms (hereinafter referred to as "A-Si"), for example, as disclosed in Offenlegungsschriftes Nos. 2746967 and 2855718 which disclose use of the light receiving member as an image-forming member in electrophotography and in Offenlegungsschrift No. 2933411 which discloses use of such light receiving member in an image-reading photosensor.

For the conventional light receiving member comprising A-Si materails, there have been made improvements in their optical, electric and photoconductive characteristics such as dark resistance, photosensitivity, and photoresponsiveness, use-environmental characteristics, economic stability and durability.

However, it is still left to make further improvements in order to make such light receiving member practically usable.

For example, in the case where such conventional light receiving member is used as an image-forming member in electrophotography with the goal of heightening the photosensitivity and dark resistance, there is often observed a residual voltage on the conventional light receiving member upon use, and when it is repeatedly used for a long period of time, fatigue due to the repeated use will be accumulated to cause the so-called ghost phenomena inviting residual images.

Further, in the preparation of the conventional light receiving member using an A-Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in a light receiving layer of the light receiving member as the layer constituents.

However, the resulting light receiving layer sometimes becomes accompanied with defects on the electrical characteristics, photoconductive characteristics and/or breakdown voltage according to the way of the incorporation of said constituents to be employed.

That is, in the case of using the light receiving member having such light receiving layer, the life of a photocarrier generated in the layer with the irradiation of light is not sufficient, the inhibition of a charge injection from the side of the substrate in a dark layer region is not sufficiently carried out, and image defects likely due to a local breakdown phenomenon (the so-called "white oval marks on half-tone copies" or other image defects due to abrasion upon using a blade for the cleaning (the so-called "white line") are apt to appear on the transferred images on a paper sheet.

Further, in the case where the above light receiving member is used in a humid atmosphere, or in the case where after being placed in that atmosphere it is used, the so-called "image flow" sometimes appears on the transferred images on a paper sheet.

Further in addition, in the case of forming a light receiving light of a ten and some mμ in thickness on an appropriate substrate to obtain a light receiving member, the resulting light receiving layer is likely to invite undesired phenomena such as a thinner space being formed between the bottom face and the surface of the substrate, the layer being removed from the substrate and a carck being generated within the layer following the lapse of time after the light receiving member is taken out from the vacuum deposition chamber.

These phenomena are apt to occur in the case of using a cylindrical substrate to be usually used in the field of electrophotography.

Moreover, there have been proposed various so-called laser printers using a semiconductor laser emitting ray as the light source in accordance with the electrophotographic process. For such laser printer, there is an increased demand to provide an improved light receiving member of having a satisfactorily rapid responsiveness to light in the long wave region in order to enhance its function.

In consequence, it is required not only to make a further improvement in an A-Si material itself for use in forming the light receiving layer of the light receiving member but also to establish such a light receiving member which will not invite any of the foregoing problems and to satisfy the foregoing demand.

SUMMARY OF THE INVENTION

The object of this invention is to provide a light receiving member comprising a light receiving layer mainly composed of A-Si, free from the foregoing problems and capable of satisfying various kind of requirements.

That is, the main object of this invention is to provide a light receiving member comprising a light receiving layer constituted with A-Si in which electrical, optical and photoconductive properties are always substantially stable and hardly depend on working circumstances, and which is excellent against optical fatigue, causes no degradation upon repeated use, excellent in durability and moisture-resistance, exhibits no or minimal residual potential and provides easy production control.

Another object of this invention is to provide a light receiving member comprising a light receiving layer composed of A-Si which has a high photosensitivity in the entire visible region of light, particularly, an excelent matching property with a semiconductor laser with rapid light response.

Other object of this invention is to provide a light receiving member comprising a light receiving layer composed of A-Si which has high photosensitivity, high S/N ratio and high electrical voltage withstanding property.

A further object of this invention is to provide a light receiving member comprising a light receiving layer composed of A-Si which is excellent in the close bondability between a substrate and a layer disposed on the substrate or between each of the laminated layers, with a dense and stable structural arrangement and of high layer quality.

These and other objects, as well as the features of this invention will become apparent by the following descriptions of preferred embodiments according to this invention while referring to the accompanying drawings.

DETAILED DESCRIPTION OF THE INVENTION

Figure 1A:
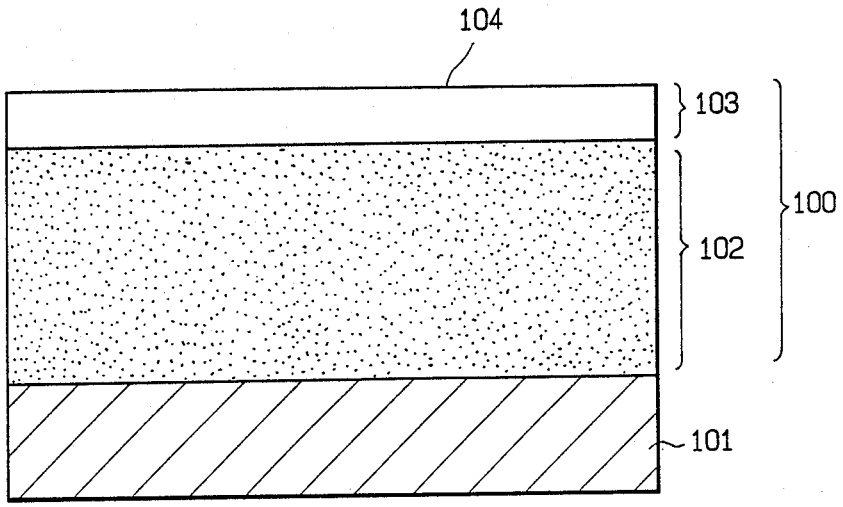
FIG. 1(A) and 1(B) are views of schematically illustrating representative examples of the light receiving member according to this invention.

The present inventors have made detailed studies for overcoming the foregoing problems on the conventional light receiving members and attaining the objects as described above and, as a result, has accomplished this invention based on the finding as described below.

As a result of the studies focusing on materiality and practical applicability of a light receiving member comprising a light receiving layer composed A-Si for use in electrophotography, solid image-pickup device and image-reading device, the present inventors have obtained the following findings.

This is, the present inventors having found that in case where the light receiving layer compose of an amorphous material containing silicon atoms as the main constituent atoms is so structured as to have a particular two-layer structure as later described, the resulting light receiving member provides many particularly excellent characteristics especially usable for electrophotography which are superior to the conventional light receiving members in any of the requirements.

In more detail, the present inventors have found that when the light receiving layer is so structured as to have two layer structure using the so-called hydrogenated amorphous silicon material, halogenated amorphous silicon material or halogen-containing hydrogenated amorphous silicon material, namely, represented by amorphous materials containing silicon atoms as the main constituent atoms (Si), and at least one of hydrogen atoms (H) and halogen atoms (X) [hereinafter referred to as "A-Si (H, X)], the resulting light receiving member becomes such that brings about the foregoing unexpected effects.

Accordingly, the light receiving member to be provided according to this invention is characterized as comprising a substrate and a light receiving layer having a first layer of having photoconductivity which is constituted of an amorphous material containing silicon atoms as the main constituent atoms and an element for controlling the conducitivity being unevenly distributed in the entire layer region or in the partial layer region adjacent to the substrate and a second layer which is constituted with an amorphous material containing silicon atoms as the main constituent atoms, carbon atoms and an element for controlling the conductivity being uniformly distributed.

The first layer may also contain germanium atoms in an uniformly distributed state in the entire layer region or in the practical layer region adjacent to the substrate.

As the amorphous material containing silicon atoms as the main constituent atoms to be used for the formation of the first layer, there can be the so-called hydrogenated amorphous silicon, halogenated amorphous silicon and halogen-containing hydrogenated amorphous silicon, namely, represented by amorphous materials containing silicon atoms (Si) as the main constituent atoms and at the least one kind selected from hydrogen atoms (H) and halogen atoms (X) [hereinafter referred to as "A-Si(H,X)"].

As the amorphous material containing silicon atoms as the main constituent atoms to be used for the formation of the second layer, there is used an amorphous material containing silicon atoms (Si) as the main constituent atoms, carbon atoms (C), and at least one kind selected from hydrogen atoms (H) and halogen atoms (X) [hereinafter referred to as "A-SiC(H,X)"].

As the foregoing element for controlling the conductivity, there can be the so-called impurities in the field of the semiconductor, and those usable herein include atoms belonging to the Group III of the periodical table that provide p-type conductivity (hereinafter simply referred to as "group III atom") or atoms belonging to the group V of the periodical table that provide n-type conductivity (hereinafter simply referred to as "group V atom"). Specifically, the group III atoms can include B (boron), Al (aluminum), Ga (gallium), In (indium) and Tl (thallium), B and Ga being particularly preferred. The group V atoms can include, for example, P (phosphorous), As (arsenic), Sb (antimony) and Bi (bismuth), P and As being particularly preferred.

In the case where both the first layer and the second layer contains an element for controlling the conductivity, the kind of the element to be contained in the first layer can be the same as or different from that to be contained in the second layer.

As the halogen atom (X) to be contained in the first layer and/or in the second layer in case where necessary, there can be mentioned fluorine, chlorine, bromine and iodine. Among these halogen atoms, fluorine and chlorine are most preferred.

The first layer and/or the second layer may contain hydrogen atoms (H) where necessary. In that case, the amount of the hydrogen atoms (H), the amount of the halogen atoms (X) or the sum of the amounts for the hydrogen atoms and the halogen atoms (H+X) to be incorporated in the first layer and/or the second layer is preferably $1\times10^{-2}$ to $4\times10$ atomic %, more preferably, $5\times10^{-2}$ to $3\times10$ atomic %, and, most preferably, $1\times10^{-1}$ to 25 atomic %.

The light receiving member according to this invention will now be explained more specifically referring to the drawings. The description is not intended to limit the scope of the invention.

Figure 1B:
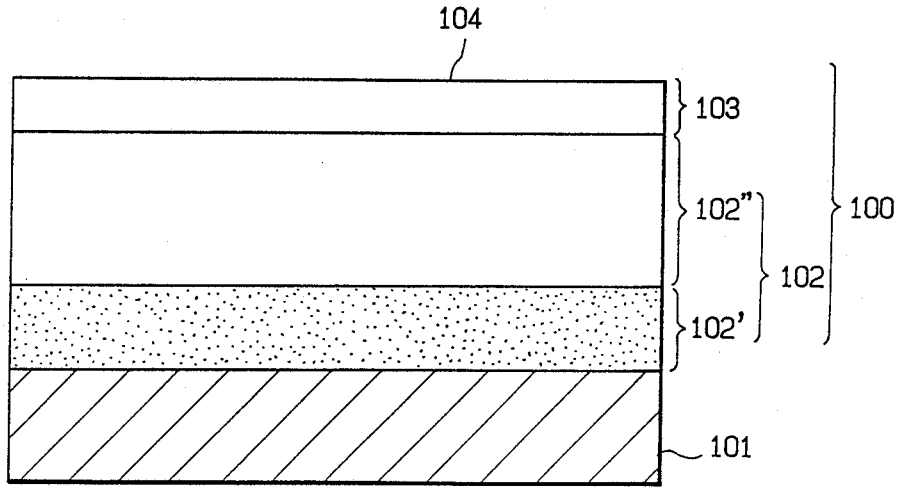

FIGS. 1(A) and 1(B) are schematic views illustrating the typical layer structures of the light receiving member of this invention, in which are shown the light receiving member 100, the substrate 101, the first layer 102 and the second layer 103 having a free surface 104.

Substrate (101)

The substrate 101 for use in this invention may either be electroconductive or insulative. The electroconductive support can include, for example, metals such as NiCr, stainless steels, Al, Cr, Mo, Au, Nb, Ta, Ti, Pt and Pb or the alloys thereof.

The electrically insulative substrate can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1(A) and 1(B) as image forming member for use in electronic photography, it is desirably configurated into an endless belt or cylindrical form continuous high speed reproduction. The thickness of the substrate member is properly determined so that the light receiving member as described can be formed.

In the case that flexibility is required for the light receiving member, it can be made as thin as possible within a range capable of sufficiently providing the function as the substrate. However, the thickness is usually greater than 10 $\mu$m in view of the fabrication and handling or mechanical strength of the substrate.

First Layer (102)

The first layer 102 is disposed between the substrate 101 and the second layer 103 as shown in FIGS. 1(A) and 1(B).

Basically, the first layer 102 is composed of A-Si (H,X) which contains the element for controlling the conductivity, the group III atoms or the group V atoms, in the state of being distributed unevenly in the entire layer region or in the partial layer region adjacent to the substrate 101 (herinafter, the uneven distribution means that the distribution of the related atoms in the layer is uniform in the direction parallel to the surface of the substrate but is uneven in the thickness direction).

The purpose and the expected effect of incorporating the element for controlling the conductivity in the first layer of the light receiving member according to this invention will vary depend upon its distributing state in the layer as below described.

That is, in the case of incorporating the element largely in the partial layer region adjacent to the substrate, the effect as the charge injection inhibition layer is brought about. In this case, the amount of the element to be contained is relatively large. In view of this, it is preferably from 30 to $5\times10^4$ atomic ppm, more preferably from 50 to $1\times10^4$ atomic ppm, and, more preferably, from $1\times10^2$ to $5\times10^3$ atomic ppm.

Adversely in the case of incorporating the element largely in the partical layer region of the first layer adjacent to the second layer, if the conduction type of the element is the same both in the first layer and the second layer, the effect to improve the matching of energy level between the first layer and the second layer and to promote movement of an electric charge between the two layers is brought about. And this effect is particularly significant in the case where the thickness of the second layer is large and the dark resistance of the layer is high.

Further, in the case of incorporating the element largely in the partial layer region of the first layer adjacent to the second layer, if the conduction type of the element to be contained in the first layer is different from that of the element to be contained in the second layer, the partial layer region containing the element at high concentration functions purposely as the composition part and the effect to increase an apparent dark resistance in the electrification process is brought about.

In the case where a relatively large amount the element is incorporated in the partial layer region of the first layer adjacent to the second layer, in each case, the amount of the element is sufficient to be relatively small. In view of this, it is preferably from $1\times10^{-3}$ atomic ppm, more preferably from $5\times10^{-2}$ to $5\times10^2$ atomic ppm, and, most preferably, from $1\times10^{-1}$ to $5\times10^2$ atomic ppm.

In the following, an explanation is made on the typical example when the thicknesswise distributing concentration of the element for controlling the conductivity is uneven, with reference to FIGS. 2 through 10.

In FIGS. 2 through 10 relate to typical embodiments in which the group III or group V atoms incorporated into the light first layer are so distributed that the amount therefor is relatively great on the side of the substrate, decreased from the substrate toward the free surface of the light receiving layer, and is relatively smaller or substantially equal to zero near the end on the side of the free surface.

In FIGS. 2 through 10, the abscissa represents the distribution concentration C of the group III atoms or group V atoms and the ordinate represents the thickness of the first layer; and $t_B$ represents the interface position between the substrate and the first layer and $t_T$ represents the interface position between the first layer and the second layer.

Figure 2:
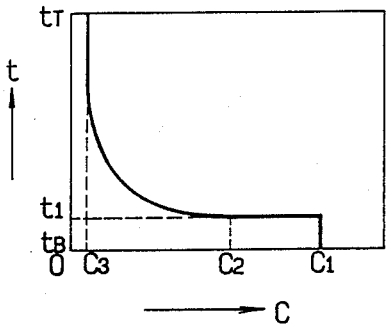
FIGS. 2 through 10 are views illustrating the thicknesswise distribution of the group III atoms or the group V atoms in the first layer of the light receiving member according to this invention, the ordinate representing the thickness of the layer and the abscissa representing the distribution concentration of respective atoms.

FIG. 2 shows the first typical example of the thicknesswise distribution of the group III atoms or group V atoms in the light receiving layer. In this example, the group III atoms or group V atoms are distributed such that the concentration C remains constant at a value $C_1$ in the range from position $t_1$ to position $t_T$, where the concentration of the group III atoms or group V atoms is $C_3$.

Figure 3:
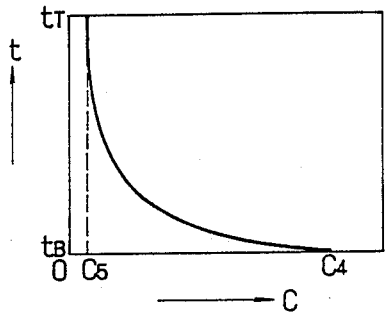

In the example shown in FIG. 3, the distribution concentration C of the group III atoms or group V atoms contained in the first layer is such that concentration $C_4$ at position $t_B$ continuously decreases to concentration $C_5$ at position $t_T$.

Figure 4:
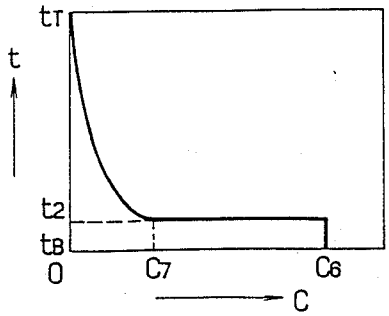

In the example shown in FIG. 4, the distribution concentration C of the group III atoms or group V atoms is such that concentration $C_6$ remains constant in the range from position $t_B$ to position $t_2$ and it gradually and continuously decreases in the range from position $t_2$ to position $t_T$. The concentration at position $t_T$ is substantially zero (wherein "substantially zero" means that the concentration is lower than the detectable limit).

Figure 5:
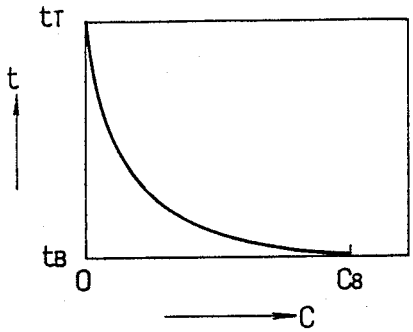

In the example shown in FIG. 5, the distribution concentration C of the group III atoms or group V atoms is such that concentration $C_8$ gradually and continuously decreases in the range from position $t_B$ to position $t_B$, at which it is substantially zero.

Figure 6:
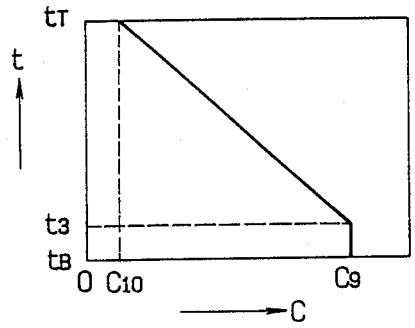

In the example shown in FIG. 6, the distribution concentration C of the group III atoms or group V atoms is such that concentration $C_9$ remains constant in the range from position B to position $t_3$, and concentration $C_8$ linearly decreases to concentration $C_{10}$ in the range from position $t_3$ to position $t_T$.

Figure 7:
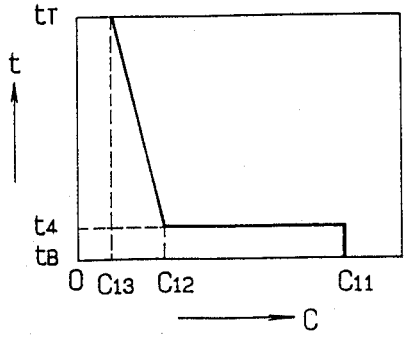
Figure 8:
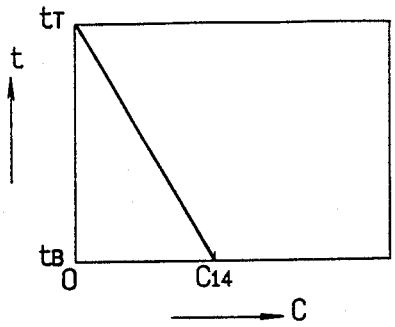
Figure 9:
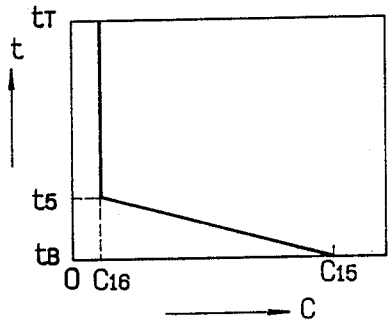
Figure 10:
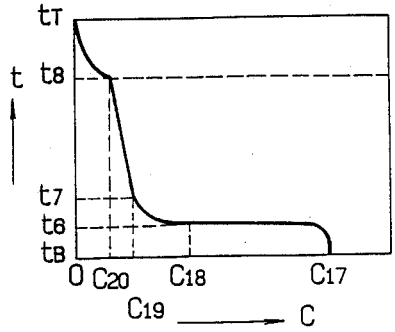

In the example shown in FIG. 7, the distribution concentration C of the group III atoms or group V atoms is such that concentration $C_{11}$ layer region near the second layer, the foregoing effect that the layer region A where the group III or group V atoms are distributed at a higher concentration can form the charge injection inhibition layer as described above more effectively, by disposing a localized region A where the distribution concentration of the group III or group V atoms is relatively higher at the portion near the side of the support, preferably, by disposing the localized region A at a position within 5 μm from the interface position adjacent to the substrate surface.

As above-mentioned, the distribution state of the group III or group V atoms in the first layer of this invention is determined properly based on a desired purpose. This situation is apparent from what are mentioned in FIGS. 2 through 10, which are, however, only the typical examples. That is, in other distribution states than those mentioned above may be taken. For example, in the case where the concentration of the group III or group V atoms in the partial layer region near the interface between the first layer and the second layer is relatively high or in the case where the concentration of the group III or group V atoms in the center partial layer region is relatively high, the modified distribution states based on FIGS. 2 through 10 can be properly and applicably employed.

In order to incorporate germanium atoms in the first layer 102 of the light receiving member of this invention, the germanium atoms are incorporated in the entire layer region or in the partial layer region adjacent to the substrate respectively uniformly distributed state.

In the case of incorporating germanium atoms in the first layer, an absorption spectrum property in the long wavelength region of the light receiving membker may be improved. That is, the light receiving member according to this invention becomes to give excellent various properties by incorporating germanium atoms in the first layer. Particularly, it becomes more sensititve to light of wavelengths broadly ranging from short wavelength to long wavelength covering visible light and it also becomes quickly responsive to light.

This effect becomes more significant when a semiconductor laser is used as the light source.

In the case of incorporating germanium atoms in an uniformly distributed state in the entire layer region of the first layer, the amount of germanium atoms to be contained should be properly determined so that the objects of the invention is effectively achieved. In view of the above, it is preferably from/to $t \times 10^5$ atomic ppm, and, most preferably, from $1 \times 10^2$ 1 to $2 \times 10^5$ atomic ppm.

In the case of incorporating germanium atoms in the partial layer region adjacent to the substrate, the occurrence of the interference due to the light reflection from the surface of the substrate can be effectively prevented wherein a semiconductor laser is used as the light source.

FIG. 1(B) is a schematic view illustrating the typical layer constitution of the light receiving member in the case of incorporating germanium atoms in the partial layer region in the first layer in an uniformly distributed state, in which are shown the substrate 101, the first layer 102, a first layer region 102' constituted with A-Si(H,X) containing germanium atoms in an uniformly distributed state [hereinafter referred to as "A-SiGe(H,X)", a second layer region 102" constituted with A-Si(H,X) containing no germanium atoms, and the second layer 103.

That is, the light receiving member shown in FIG. 1(B) becomes to have a layer constitution that a first layer region formed of A-SiGe(H,X) and a second layer region formed of A-Si(H,X) are laminated on the substrate in this order from the side of the substrate, and further the second layer 103 is laminated on the first layer 102. When the layer constitution of the first layer takes such a layer constitution as shown in FIG. 1(B), particularly in the case of using light of long wavelength such as a semiconductor laser as the light source, the light of long wavelength, which can be minimally absorbed in the second layer region 102", can be substantially and completely absorbed in the first layer region 102'. And this is directed to prevent the interference caused by the light reflected from the surface of the substrate.

The amount of germanium atoms contained in the first layer region 102' should be properly determined so that the object of the invention is effectively achieved. It is preferably from 1 to $1 \times 10^7$ atomic ppm, more preferably from $1 \times 10^2$- $9.5 \times 10^5$ atomic ppm, and, most preferably, from $5 \times 10^2$ - $8 \times 10^5$ atomic ppm.

The thickness ($T_B$) of the first layer region 102' and the thickness (T) of the second layer region 102" are important factors for effectively attaining the foregoing objects of this invention, and they are desirably determined so that the resulting light receiving member becomes accompanied with many desired practically applicable characteristics.

The thickness ($T_B$) of the first layer region 102 ' is preferably from $3 \times 10^{-3}$ to 50 μm, more preferably from $4\times10^{-3}$ to 40 μm, and, most preferably, from 5 x $10^{-3}$ to 30 μm. And the thickness (T) of the second layer region is preferably from 0.5 to 90 μm, more preferably from 1 to 80 μm, and most preferably, from 2 to 5 μm.

And, the sum ($T_B$+T) of the thickness ($T_B$) for the former layer region and that (T) for the latter layer region is desirably determined based on relative and organic relationships with the characteristics required for the first layer 102.

It is preferably from 1 to 100 μm, more preferably from 1 to 80 μm, and, most prerferably, from 2 to 50 μm. Further, for the relationship of the layer thickness $T_B$ and the layer thickness T, it is preferred to satisfy the equation: $T_B/T\leqq1$, more preferred to satisfy the equation: $T_B/T\leqq0.9$, and, most preferred to satisfy the equation: $T_B/T\leqq0.8$. In addition, the layer thickness ($T_B$) of the layer region containing germanium atoms is determined based on the amount of the germanium atoms to be contained in that layer region. For example, in the case where the amount of the germanium atoms to be contained therein is more than $1\times10^5$ atomic ppm, the layer thickness $T_B$ is destined to be remarkably large.

Specifically, it is preferably less than 30 μm, more preferably less than 25 μm, and, most preferably, less than 20 μm.

Second Layer (103)

The second layer 103 having the free surface 104 is disposed on the first layer 103 to attain the objects chiefly of moisture resistance, deterioration resistance upon repeating use, electrical voltage withstanding property, use environmental characteristics and durability for the light receiving member according to this invention.

The second layer is formed of an amorphous material containing silicon atoms as the constituent atoms which are also contained in the layer constituent amorphous material for the first layer, so that the chemical stability at the interface between the two layers is sufficiently secured.

Typically, the surface layer is formed of an amorphous material containing silicon atoms, carbon atoms and hydrogen atoms and/or halogen atoms in case where necessary [hereinafter referred to as "A-SiC(H,X)"]. The foreging objects for the second layer can be effectively attained by introducing carbon atoms structurally into the second layer. And, the case of introducing carbon atoms structurally into the second layer, following the increase in the amount of carbon atoms to be introduced, the above-mentioned characteristics will be promoted, but its layer quality and its electric and mechanical characteristics will be decreased if the amount is excessive.

In view of the above, the amount of carbon atoms to be contained in the second layer is preferably $1\times10^{-3}$ to 90 atomic %, more preferably 1 to 90 atomic %, and, most preferably, 10 to 80 atomic %.

For the layer thickness of the second layer, it is desirable to be thickened. But the problem due to generation of a residual voltage will occur in the case where it is excessively thick. In view of this, by incorporating an element for controlling the conductivity such as the group III atom or the group V atom in the second layer, the occurrence of the above problem can be effectively prevented beforehand. In that case, in addition to the above effect, the second layer becomes such that is free from any problems due to, for example, socalled scratches which will be caused by a cleaning means such as blade and which invite defects on the transferred images in the case of using the light receiving member in electrophotography.

In view of the above, the incorporation of the group III or group V atoms in the second layer is quite beneficial for forming the second layer having appropriate properties as required.

And, the amount of the group III or group V atoms to be contained in the second layer is preferably 1.0 to $1\times10^4$ atomic ppm, more preferably 10 to $5\times10^3$ atomic ppm, and, most preferably, $10^2$ to $5\times10^3$ atomic ppm. The formation of the second layer should be carefully carried out so that the resulting second layer brings about the characteristics required therefor.

By the way, the texture state of a layer constituting material which contains silicon atoms, carbon atoms, hydrogen atoms and/or halogen atoms, and the group III atoms on the group V atoms takes from crystal state to amorphous state which show from a semiconductive property to an insulative property for the electric and physical property and which show from a photoconductive property to a non-photoconductive property for the optical and electric property upon the layer forming conditions and the amount of such atoms to be incorporated in the layer to be formed.

In view of the above, for the formation of a desirable layer to be the second layer 103 which has the required characteristics, it is required to chose appropriate layer forming conditions and an appropriate amount for each kind of atoms to be incorporated so that such second layer may be effectively formed. For instance, in the case of disposing the second layer 103 aiming chiefly at the improvement in the electrical voltage withstanding property, that layer is formed of such an amorphous material that invites a significant electrically-insulative performance on the resulting layer.

Further, in the case of disposing the second layer 103 aiming chiefly at the improvement in the deterioration resistance upon repeating use, the using characteristics and the use environmental characteristics, that lay is formed of such an amorphous material that eases the foregoing electrically-insulative property to some extent but bring about certain photosensitivity on the resulting layer.

Further in addition, the adhesion of the second layer 103 with the first layer 102 may be further improved by incorporating oxygen atoms and/or nitrogen atoms in the second layer in a uniformly distributed state.

For the light receiving member of this invention, the layer thickness of the second layer is also an important factor for effectively attaining the objects of this invention. Therefore, it is appropriately determined depending upon the desired purpose.

It is, however, also necessary that the layer thickness be determined in view of relative and organic relationships in accordance with the amounts of silicon atoms, carbon atoms, hydrogen atoms, halogen atoms, the group III atoms, and the group V atoms to be contained in the second layer and the characteristics required in relationship with the thickness of the first layer.

Further, it should be determined also in economical viewpoints such as productivity or mass productivity. In view of the above, the layer thickness of the second layer is preferably $3\times10^{-3}$ to 30 μm, more preferably $4\times10^{-3}$ to 20 μm, and most preferably, $5\times10^{-3}$ to 10 μm.

As above explained, since the light receiving member of this invention is structured by laminating a special first layer and a speical second layer on a substrate, almost all the problems which are often found on the conventional light receiving member can be effectively overcome.

Further, the light receiving member of this invention exhibits not only significantly improved electric, optical and photoconductive characteristics, but also significantly improved electrical voltage withstanding property and use environmental characteristics. Further in addition, the light receiving member of this invention has a high photosensitivity in the entire visible region of light, particularly, an excellent matching property with a semiconductor laser and shows rapid light response.

And when the light receiving member is applied for use in electrophotography, it not give undesired effects at all of the residual voltage to the image formation but gives stable electrical properties high sensitivity and high S/N ratio, excellent light fastness and property for repeating use, high image density and clear half tone. At it can provide high quality image with high resolution power repeatedly.

Preparation of First Layer (102) and Second Layer (103)

The method of forming the light receiving layer of the light receiving member will be now explained.

Each of the first layer 102 and the second layer 103 to constitute the light receiving layer of the light receiving member of this invention is properly prepared by vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the layers having desired properties are relatively easy, and hydrogen atoms, halogen atoms and other atoms can be introduced easily together with silicon atoms. The glow discharging method and the sputtering method may be used together in one identical system.

Preparation of First Layer (102)

Basically, when layer constituted with A-Si(H,X) is formed, for example, by the glow discharging method, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of A-Si(H,X) is formed on the surface of a substrate placed in the deposition chamber.

The gaseous starting material for supplying Si can include gaseous or gasifiable silicon hydrides (silanes) such as $SiH_4$, $Si_2H_6$, $Si_3H_8$, $Si_4H_{10}$, etc., SiH *being particularly preferred in view of the easy layer forming work and the good efficiency for the supply of Si.*

Further, various halogen compounds can be mentioned as the gaseous starting material for introducing the halogen atoms, and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_7$, IF, ICl, IBr, etc.; and silicon halides such as $SiF_4$, $Si_2F_6$, $SiC_4$, and $SiBr_4$. The use of the gaseous or gasifiable silicon halide as described above is particularly advantageous since the layer constituted with halogen atom-containing A-Si:H can be formed with additional use of the gaseous starting silicon hydride material for supplying Si.

In the case of forming a layer constituted with an amorphous material containing halogen atoms, typically, a mixture of a gaseous silicon halide substance as the starting material for supplying Si and a gas such as Ar, $H_2$ and He is introduced into the deposition chamber having a substrate in a predetermined mixing ratio and at predetermined gas flow rate, and the thus introduced gases are exposed to the action of glow discharge to thereby cause a gas plasma resulting in forming said layer on the substrate.

For for incorporating hydrogen atoms in said layer, an appropriate gaseous starting material for supplying hydrogen atoms can be additionally used.

The gaseous starting material usable for supplying hydrogen atoms include those gaseous or gasifiable materials, for example, hydrogen gas ($H_2$), halides such as HF, HCl, HBr, and HI, silicon hydrides such as $SiH_4$, $Si_2H_6$, $Si_3H_8$, and $Si_4H_{10}$, or halogen-substituted silicon hydrides such as $SiH_2F_2$, $SiH_2I_2$, $SiH_2Cl_2$, $SiHCl_3$, Si and $SiHBr_3$. The use of these gaseous starting material is advantageous since the content of the hydrogen atoms (H), which are extremely effective in view of the control of the electrical or photoelectronic properties, can be controlled with ease. The use of the hydrogen halide or the halogen-substituted silicon hydride as described above is particularly advantageous since the hydrogen atoms (H) are also introduced together with the introduction of the halogen atoms.

The amount of the hydrogen atoms (H) and/or the amount of the halogen atoms (X) to be contained in a layer are adjusted properly by controlling related conditions, for example, the temperature of a substrate, the amount of a gaseous starting material capable of supplying the hydrogen atoms or the halogen atoms into the deposition chamber and the electric discharging power.

In the case of forming a layer composed of A-Si(H,X) by the reactive sputtering process, the layer is formed on the substrate by using a Si target and sputtering the Si target in a plasma atmosphere.

To form said layer by the ion-plating process, the vapor of silicon is allowed to pass through a desired gas plasma atmosphere. The silicon vapor is produced by heating polycrystal silicon or single crystal silicon held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms in accordance with the sputtering process, a feed gas to liberate hydrogen is introduced into the deposition chamber in which a plasma atmosphere of the gas is produced. The feed gas to liberate hydrogen atoms includes $H_2$ gas and the above-mentioned silanes.

For the formation of the layer in accordance with the glow discharging process, reactive sputtering process or ion plating process, the foregoing halide or halogen-containing silicon compound can be effectively used as the starting material for supplying halogen atoms. Other effective examples of said material can include hydrogen halides such as HF, HCl, HBr and HI and halogen-substituted silanes such as $SiH_2F_2$, $SiH_2I_2$, $SiH_2Cl_2$, $SiHCl_3$, SiH and $SiHBr_3$, which contain hydrogen atom as the constituent element and which are in the gaseous state or gasifiable substances. The use of the gaseous or gasifiable hydrogen-containing halides is particularly advantageous since, at the time of forming a light receiving layer, the hydrogen atoms, which are extremely effective in view of controlling the electrical or electrophotographic properties, can be introduced into that layer together with halogen atoms.

The structural introduction of hydrogen atoms into the layer can be carried out by introducing, in addition to these gaseous starting materials, $H_2$, or silicon hydrides such as $SiH_4$, $SiH_6$, $Si_3H_6$, $Si_4H_{10}$, etc. into the deposition chamber together with a gaseous or gasifiable silicon-containing substance for supplying Si, and producing a plasma atmosphere with these gases therein.

For example, in the case of the reactive sputtering process, the layer composed of A-Si(H,X) is formed on the substrate by using a Si target and by introducing a halogen atom introducing gas and $H_2$ gas, if necessary, together wth an inert gas such as He or Ar into the deposition chamber to thereby form a plasma atmosphere and then sputtering the Si target.

As for hydrogen atoms (H) and halogen atoms (X) to be optionally incorporated in the layer, the amount of hydrogen atoms or halogen atoms, or the sum of the amount for hydrogen atoms and the amount for halogen atoms (H+X) is preferably 1 to 40 atomic %, and more preferably, 5 to 30 atomic %.

The control of the amounts for hydrogen atoms (H) and halogen atoms (H) to be incorporated in the layer can be caried out by controlling the temperature of a substrate, the amount of the starting material for supplying hydrogen atoms and/or halogen atoms to be introduced into the deposition chamber, discharging power, etc.

The formation of a layer composed of A-Si(H,X) containing germanium atoms, the group III atoms or the group V atoms in accordance with the glow discharging process, reactive suttering process or ion plating process can be carried out by using the starting material for supplying germanium atoms, the starting material for supplying oxygen atoms or/and nitrogen atoms, and the starting material for supplying the group III or group V atoms together with the staring materials for forming an A-Si(H,X) material and by incorporating relevant atoms in the layer to be formed while controlling their amounts properly.

To form the layer of A-SiGE(H,X) by the glow discharge process, a feed gas to liberate silicon atoms (Si), a feed gas to liberate germanium atoms (Ge), and a feed gas to liberate hydrogen atoms (H) and/or halogen atoms (X) are introduced under appropriate gaseous pressure condition into an evacuatable deposition chamber, in which the glow discharge is generated so that a layer or a-SiGe (H,X) is formed on the properly positioned substrate in the chamber.

The feed gases to supply silicon atoms, halogen atoms, and hydrogen atoms are the same as those used to form the layer of A-SiGe(H,X) mentioned above.

The feed gas to liberate Ge includes gaseous or gasifiable germanium halides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, with $GeH_4$, $Ge_2H_6$ and $Ge_3H_8$, being preferable on account of their ease of handling and the effective liberation of germanium atoms.

To form the layer of A-SiGe(H,X) by the sputtering process, two targets (a slicon target and a germanium target) or a single target composed of silicon and germanium is subjected to sputtering in a desired gas atmosphere.

To form the layer of A-SiGe(H,X) by the ion-plating process, the vapors of silicon and germanium are allowed to pass through a desired gas plasma atmosphere. The silicon vapor is produced by heating polycrystal silcon or single crystal silicon held in a boat, and the germanium vapor is produced by heating polycrystal germanium or single crystal germanium held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms, a feed gas to liberate hydrogen is introduced into the deposition chamber in which a plasma atmosphere of the gas is produced. The feed gas may be gaseous hydrogen, silanes, and/or germanium hydrides. The feed gas to liberate halogen atoms includes the above-mentioned halogen-containing silicon compounds. Other examples of the feed gas include hydrogen halides such as HF, HCl, HBr, and HI; halogen-substituted silanes such as $SiH_2F_2$, $SiH_2I_2$, $SiH_2Cl_2$, $SiHCl_3$, $SiH_2Br_2$, and $SiHBr_3$, germanium hydride halide such as $GeHF_3$, $Geh_2F_2$, $GeH_3F$, $GeHCl_3$, $GeH_2Cl_2$, $GeH_3Cl$, $GeHBr_3$, $GeH_2Br_2$, $GeH_3Br$, GeH- and $GeH_3I$; and germanium halides such as $GeF_4$, $GeCl_4$, $GeBr_4$, $GeI_4$, $GeF_2$, $GeCl_2$, $GeBr_2$, and $GeI_2$. They are in the gaseous form or gasifiable substances.

In order to form a layer or a partial layer region constituted with A-Si(H,X) further incorporated with the group III atoms or the group V atoms using the glow discharging process, reactive sputtering process or ion-plating process, the starting materials for supplying the group III atoms or the group V atoms are used together with the starting materials for forming an A-Si(H,X) upon forming the layer or the partial layer region while controlling their amounts to be incorporated therein.

Similarly layer or a partial layer region constituted with A-SiGe (H,X)(M) can be properly formed.

As the starting materials for supplying the group III atoms and the group V atoms, most of gaseous or gasifiable materials which contain at least such atoms as the constituent atoms can be used.

Referring specifically to the boron atoms introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. In addition $AlCl_3$, $CaCl_3$, $Ga(CH_3)_2$, $InCl_3$, $TlCl_3$, and the like can also be mentioned.

Referring to the starting material for introducing the group V atoms and, specifically, to the phosphorous atoms introducing materials, they can include, for example, phosphorous hydrides such as $PH_3$ and $P_2H_6$ and phosphrus halides such as $PH_4I$, $PF_3$, $PF_5$, $PCl_3$, $PCl_5$, $PBr_3$, $PBr_5$, and $PI_3$. In addition, $AsH_3$, $AsF_5$, $AsCl_3$, $ASBr_3$, $AsF_3$, $SbH_3$, $SbF_3$, $SbF_5$, $SbCl_3$, $sbCl_5$, $BiH_3$, $BiCl_{BiBr3}$ can also be mentioned to as the effective starting material for introducing the group V atoms.

Preparation of Second Layer (103)

The second layer 103 constituted with an amorphous material containing silicon atoms as the main constituent atoms, carbon atoms, the group III atoms or the group V atoms, and optionally one or more kinds selected from hydrogen atoms, halogen atoms, oxygen atoms and nitrogen atoms [hereinafter referred to as "A-SiCM(H,X)(O,N)" wherein M stands for the group III atoms or the group V atoms]can be formed in accordance with the glow discharging process, reactive sputtering process or ion-plating process by using appropriate starting materials for supplying relevant atoms together with the starting materials for forming an A-Si(H,X) material and incorporating relevant atoms in the layer to be formed while controlling their amounts properly.

For instance, in the case of forming the second layer in accordance with the glow discharging process, the gaseous starting materials for forming A-SiCM (H,X)(O,N) are introduced into the deposition chamber having a substrate, if necessary, while mixing with a dilution gas in a predetermined mixing ratio, the gaseous materials are exposed to a glow discharing power energy to thereby generate gas plasmas resulting in forming a layer to be the second layer 103 which is constituted with A-SiCM (H,X)(O,N) on the substrate.

In the typical embodiment, the second layer 103 is represented by a layer constituted with A-SiCM(H,X).

In the case of forming said layer, most of gaseous or gasifiable materials which contain at least one kind selected from silicon atoms (Si), carbon atoms (C), hydrogen atoms (H) and/or halogen atoms (X), the group III atoms or the group V atoms as the constituent atoms can be used as the starting materials.

Specifically, in the case of using the glow discharging process for forming the layer constituted with A-SiCM(H,X), a mixture of a gaseous starting material containing Si as the constituent atoms, a gaseous starting material containing C as the constituent atoms, a gaseous starting material containing the group III atoms or the group V atoms as the constituent atoms and, optionally a gaseous starting material containing H and or X as the constituent atoms in a required mixing ratio: a mixture of a gaseous staring material containing Si as the constituent atoms, a gaseous material containing C, H and/or X as the constituent atoms and a gaseous material containing the group III atoms or the group V atoms as the constituent atoms in a required mixing ratio: or a mixture of a gaseous material containing Si as the constituent atoms, a gaseous starting material containing Si, C and H or/and X as the constituent atoms and a gaseous starting material containing the group III or the group V atoms as the constituent atoms in a required mixing radio are optionally used.

Alternatively, a mixture of a gaseous staring material containing Si, H and/or X as the constituent atoms, a gaseous starting material containing C as the constituent atoms and a gaseous starting material containing the group III atoms or the group V atoms as the constituent atoms in a required mixing ratio can be effectively used.

Those gaseous starting materials that are effectively usable herein can include gaseous silicon hydrided comprising C and H as the constituent atoms, such as silanes, for example, $SiH_4$, $Si_2H_6$, $Si_3H_8$ and $Si_4H_{10}$, well as those comprising C and H as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_3$) and butine ($C_4H_6$).

The gaseous starting material comprising Si, C and H as the constituent atoms can include silicified alkyls, for example, $Si(CH_3)_4$ and $Si(C_2H_5)_4$. In addition to these gaseous starting materials, $H_2$ can of course of used as the gaseous starting material for introducing H.

For the starting materials for introducing the group III atoms, the group V atoms, oxygen atoms and nitrogen atoms, those mentioned above in the case of forming the first layer can be used.

In the case of forming the layer constituted with A-SiCM(H,X) by way of the reactive sputtering process, it is carried out by using a single crystal or polycrystal Si wafer, a C (graphite) wafer or a wafer containing a mixture of Si and C as a target and sputtering them in a desired gas atmosphere.

In the case of using, for example, a Si wafer as a target, gaseous starting materials for introducing C, the group III atoms or the group V atoms, and optionally H and/or X are introduced while being optionally diluted with a dilution gas such as Ar and He into the sputtering deposition chamber to thereby generate gas plasmas with these gases and the sputter the Si wafer.

As the respective gaseous material for introducin the respective atoms, those mentioned above in the case of forming the first layer can be used.

As above explained, the first layer and the second layer to constitute the light receiving layer of the light receiving member according to this invention can be effectively formed by the glow discharging process or reactive sputtering process. The amount of germanium atoms; the group III atoms or the group V atoms; carbon atoms; and hydrogen atoms halogen haloglen atoms in the first layer of the second layer are properly controlled by regulating the gas flow rate of each of the starting materials or the gas flow ratio among the starting materials respectively entering the deposition chamber.

The conditions upon forming the first layer on the second layer of the light receiving member of the invention, for example, the temperature of the substrate, the gas pressure in the deposition chamber, and the electric discharging power are important factors for obtaining the light receiving member having desired properties and they are selected while considering the functions of the layer to be formed.

Further, since these layer forming conditions may be varied depending on the kind and the amount of each of the atoms contained in the first layer or the second layer, the conditions have to be determined also taking the kind or the amount of the atoms to be contained into consideration.

For instance, in the case of forming the layer constitued with A-Si(H,X) or the layer constituted with A-SiCM(H,X), the temperature of the support is preferably from 50 to 350° C. and, more preferably, from 50 to 250° C.; the gas pressure in the deposition chamber is preferably from 0.01 to 1 Torr and, particularly preferably, from 0.1 to 0.5 Torr; and the electrical discharging power is usually from 0.005 to 50 W/cm2, more preferably, from 0.01 to 30 W/cm2 and, particularly preferably, from 0.01 to 20W/cm2.

In the case of forming the layer constituted with A-SiGe(H,X) on the layer constituted with A-SiGe(H,X) (M), the temperature of the support is preferably from 50 to 350° C., more preferably, from 50 to 300° C., the gas pressure in the deposition chamber is usually from 0.01 to 5 Torr, more preferably, from 0.01 to 3 Torr, most preferably from 0.1 to 1 Torr; and the electrical discharging power is preferably from 0.005 to 50 W/cm2, more preferably, from 0.01 to 30 W/cm2, most preferably, from 0.01 to 20 W/cm2.

However, the actual conditions for forming the first layer on the second layer such as the temperature of the substrate, discharging power and the gas pressure in the deposition chamber cannot usually be determined with ease independnt of each other. Accordingly, the conditions optimal to the layer formation are desirably determined based on relative and organic relationships for forming the first layer and the second layer respectively having desired properties.

By the way, it is necessary that the foregoing various conditions are kept constant upon forming the light receiving layer for unifying the distribution state of germanium atoms, carbon atoms, the group III atoms or group V atoms, or hydrogen atoms or/and halogen atoms to be contained in the first layer or the second layer according to this invention.

Further, in the case of forming the first layer containing, except silicon atoms and optional hydrogen atoms or/and halogen atoms, the group III atoms or the group V atoms at a desirably distributed state in the thicknesswise direction of the layer by varying their distributing concentration in the thicknesswise direction of the layer upon forming the first layer in this invention, the layer is formed, for example, in the case of the glow discharging process, by properly varying the gas flow rate of gaseous starting material for introducing into the deposition chamber in accordance with a desired variation coefficient while maintaining other conditions constant. Then, the gas flow rate may be varied, specifically, by gradually changing the opening degree of a predetermined needle valve disposed to the midway of the gas flow system, for example, manually or any of other means usually employed such as in externally driving motor. In this case, the variation of the flow rate may not necessarily be linear but a desired content curve may be obtained, for example, by controlling the flow rate along with a previously designed variation coefficient curve by using a microcomputer or the like.

Further, in the case of forming the first layer in accordance with the reactive sputtering process, a desirably distributed state of the group III atoms or the group V atoms in the thicknesswise direction of the layer may be established by using a relevant starting material for introducing the group III or group V atoms and varying the gas flow rate upon introducing these gases into the deposition chamber in accordance with a desired variation coefficient in the same manner as the case of using the glow discharging process.

DESCRIPTION OF THE PREFERRED EMBODIMENTS

The invention will be described more specifically while referring to Examples 1 through 24, but the invention is not intended to limit the scope only to these Examples.

In each of the Examples, the first layer and the second layer were formed by using the glow discharging process.

Figure 11:
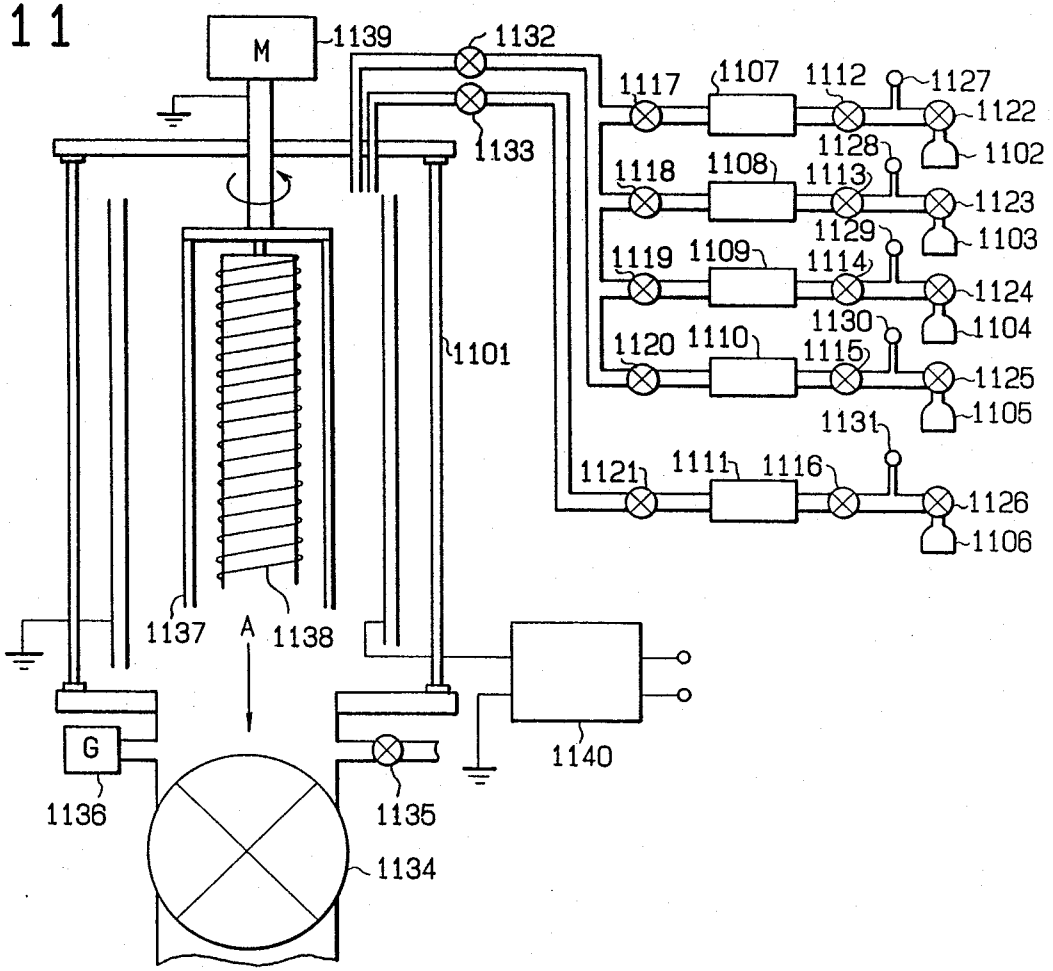
FIG. 11 is a schematic explanatory view of a fabrication device by glow discharge process as an example of the device for preparing the first layer and the second layer respectively of the light receiving member according to this invention.

FIG. 11 shows an apparatus for preparing a light receiving member according to this invention by means of the glow discharging process.

Gas reservoirs 1102, 1103, 1104, 1105, and 1106 illustrated in the figure are charged with gaseous starting materials for forming the respective layers in this invention, that is, for instance, $SiH_4$ gas (99.999% purity) in diluted with He (hereinafter referred to as "$SiH_4$/He") in gas reservoir 1102, $PH_3$ gas (99.999% purity) diluted with He (hereinafter referred to as "$PH_3$/He") in gas reservoir 1103, $B_2H_6$ gas (99.999%) purity, diluted with He (hereinafter referred to as "$B_2H_6$/He") in gas reservoir 1104, $C_2H_4$ gas (99.999% purity) in gas reservoir 1105, and $GeH_4$ gas (99.999% purity) diluted with He (hereinafter referred to as "$GeH_4$/He) in gas reservoir 1106.

In the case of incorporating halogen atoms in the layer to formed, for example, $SiF_4$ gas in another gas reservoir is used in stead of the foregoing $SiH_4$ gas.

Prior to the entrance of these gases into a reaction chamber 1101, it is confirmed that valves 1122 through 126 for the gas reservoirs 1102 through 1106 and a leak valve 1135 are closed and that inlet valves 1112 through 1116, exit valves 1117 through 1121, and sub-valves 1132 and 133 are opened. Then, a main valve 1134 is at first opened to evacuate the inside of the reaction chamber 1101 and gas piping.

Then, upon observing that the reading on the vacuum 1136 became about $5\times10^{-6}$ Torr, the sub-valves 1132 and 1133 are opened. Then, a main valve 1134 is at first opened to evacuate the inside of the reaction chamber 1101 and gas piping.

Then, upon observing that the reading on the vacuum 1136 became about $5\times10^{-6}$ Torr, the sub-valves 1132 and 1133 and exit valves 1117 through 1121 are closed.

Now, reference is made in the following to an example in the case of forming a layer to be the first layer 102 on an AL cylinder as the substrate 1137.

At first, $SiH_4$/He gas from the gas reservoir 1102 and $B_2H_6/H_6$ gas from the gas reservoir 1104 are caused to flow into mass flow controllers 1107 and 1109 respectively by opening the inlet valves 1112 and 1114 controlling the pressure of exit pressure gauges 1127 and 1129 to 1 kg/cm2. Subsequently, the exit values 1117 and 1119, and the subvalves 1132 are gradually opened to enter the gases into the reaction chamber 1101. In this case, the exit valves 1117 and 1119 are adjusted so as to attain a desired value for the ratio among the $SiH_4$/He gas and $B_2H_6$/He gas flow rate, and the opening of the main valve 1134 is adjusted while observing the reading on the vacuum gauge 1136 so as to obtain a desired value for the pressure inside the reaction chamber 1101. Then, after confirming that the temperature of the Al cylinder substrate 1137 has been set by heater 1138 within a range from 50° to 400° C., a power source 1140 is set to a predetermined electrical power to cause glow discharging in the reaction chamber 1101 while controlling the flow rates for $B_2H_6$/He gas and $SiH_4$/He gas in accordance with a previously designed variation coefficient curve by using a microcomputer (not shown), thereby forming, at first, a layer of an amorphous silicon material to be the first layer 102 containing boron atoms on the Al cylinder.

Then, a layer to be the second layer 103 is formed on the photosensitive layer. Subsequent to the procedures as described above, $SiH_4$ gas, $C_2H_4$ gas and $PH_3$gas, for instance, are optionally diluted with a dilution gas such as He, Ar and $H_2$ respectively, entered at a desired gas flow rates into the reaction chamber 1101 while controlling the gas flow rates for the $SiH_4$gas, the $C_2H_4$ gas and the $PH_3$ gas by using a micro-computer and glow discharge being caused in accordance with predetermined conditions, by which the second layer constituted with A-SiCM(H,X) is formed.

All of the exit valves other than those required for forming the respective layers are of course closed. Further, upon forming the respective layers, the inside of the system is once evacuated to a high vaccum degree as required by closing the exit valves 1117 through 1121 while opening the sub-valves 1132 and 1133 and fully opening the main valve 1134 for avoiding that the gases having been used for forming the previous layer are left in the reaction chamber 1101 and in the gas pipeways from the exit valves 1117 through 1121 to the inside of the reaction chamber 1101.

Further, during the layer forming operation, the Al cylinder as substrate 1137 is rotated at a predetermined speed by the action of the motor 1139.

EXAMPLE 1

A light receiving layer was formed on a cleaned Al cylinder under the layer forming conditions shown in Table 1 using the fabrication apparatus shown in FIG. 11 to obtain a light receiving member for use in electrophotography.

Figure 12:
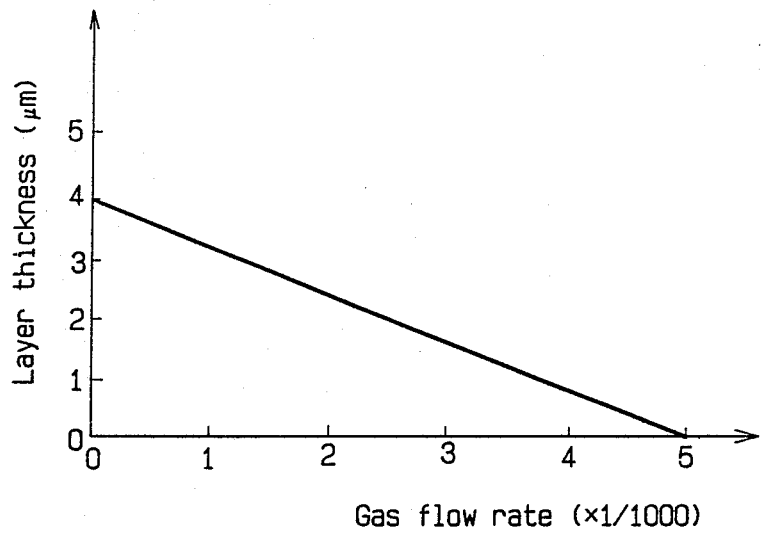
FIGS. 12 through 13 are views illustrating the variations in the gas flow ratios in forming the first layers according to this invention, wherein the ordinate represents the thickness of the layer and the abscissa represents the flow ratio of a gas to be used.

Wherein, the change in the gas flow ratio of $B_2H_6/SiH_4$ was controlled automatically using a microcomputer in accordance with the flow ratio curve shown in FIG. 12. The resulting light receiving member was set to a electrophotographic copying machine having been modified for experimental purposes, and subjected to copying tests using a test chart provided by Canon Kabushiki Kaisha of Japan under selected image forming conditions. As the light source, tungsten lamp was used.

As a result, there were obtained high quality visible images with an improved resolving power.

EXAMPLES 2 to 5

In each example, the same procedures as in Example 1 were repeated, except using the layer forming conditions shown in Tables 2 to 5 respectively, to thereby obtain a light receiving member in drum form for use in electrophotography.

Figure 13:
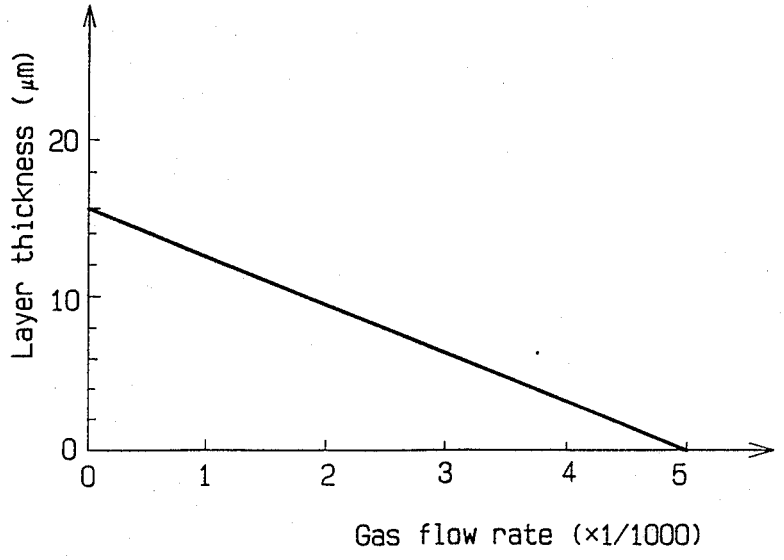
Figure 14:
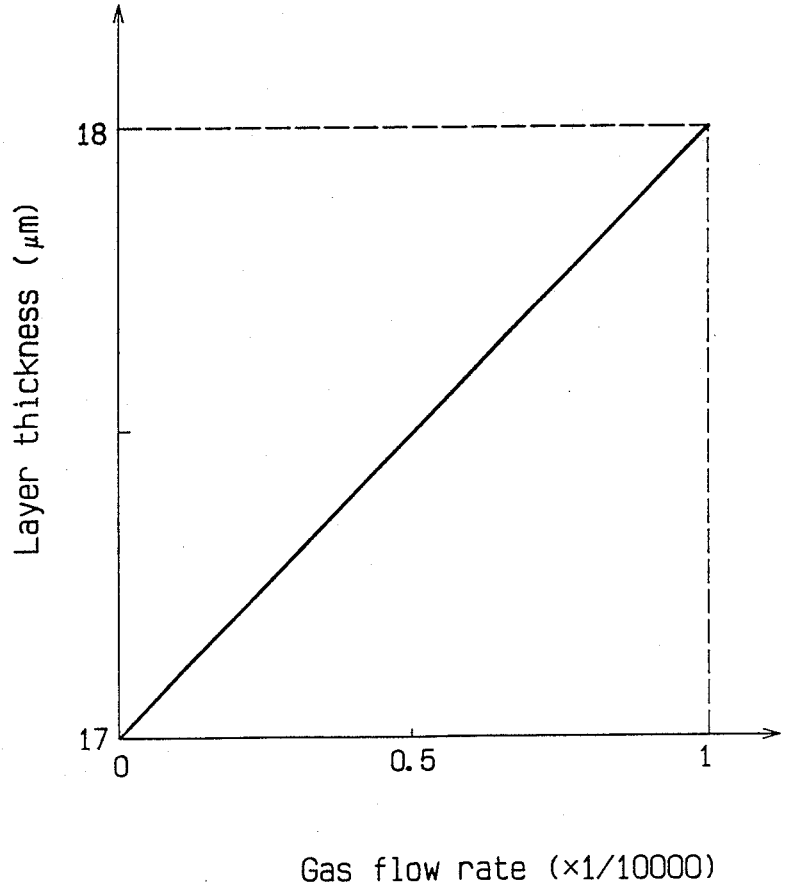

In Examples 2 and 3, the change in the gas flow ratio of $B_2H_6/SiH_4$ was controlled in accordance with the flow ratio curve shown in FIG. 13, and in Examples 4 and 5, the change in the gas flow ratio was controlled in accordance with the flow ratio curve shown in FIGS. 14 abnd 15 respectively.

The resulting light receiving members were subjected to the same copying test as in Example 1.

As a result, there were obtained high quality and highly resolved visible images for any of the light receiving members.

EXAMPLE 6

Light receiving members (Sample Nos. 601 to 607) for use in electrophotography were prepared by the same procedures as in Example 1, except that the layer thickness was changed as shown in Table 6 in the case of forming the second layer in Table 1.

The resulting light receiving members were respectively evaluated in accordance with the same image forming process as in Eaxmple 1.

The results were as shown in Table 6.

EXAMPLE 7

Light receiving members (samples NOs. 701 to 707) for use in electrophotography were prepared by the same procedures as in Example 1, except that the value relative to the flow ratio for $C_2H_4/SiH_4$ in the case of forming the second layer in Table 1 was changed as shown in Table 7.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that any of the samples has an excellent durability and always brings about high quality visible images equivalent to initial visible images.

EXAMPLES 8 TO 12

In each example, the same procedures as in Example 1 were repeated, except using the layer forming conditions shown in Tables 8 to 12 respectively, to thereby obtain a light receiving member in drum form for use in electrophotography.

In each example, the gas flow ratio for $B_2H_6/SiH_4$ were controlled in accordance with the flow ratio curve shown in the following Table A.

The resulting light receiving members were subjected to the same copying test as in Example 1.

As a result, there were obtained high quality and highly resolved visible images for any of the light receiving members.

TABLE A

| Example No. | Number of the Figure for the gas flow ratio curve for $B_2H_6/SiH_4$ |
|---|---|
| 8 | 12 |
| 9 | 13 |
| 10 | 13 |
| 11 | 14 |
| 12 | 15 |

EXAMPLE 13

Light receiving members (sample Nos. 1301 to 1307) for use in electrophotography were prepared by the same procedures as in Example 1, except that the layer thickness was changed as shown in Table 13 in the case of forming the second layer in Table 8.

The resulting light receiving members were respectively evaluated in accordance with the same image forming process as in Example 1.

The results were as shown in Table 13.

EXAMPLE 14

Light receiving members (sample Nos. 1401 to 1407) for use in electrophotography were prepared by the same procedures as in Example 8, except that the value relative to the flow ratio for $C_2H_4/SiH_4$ in the case of forming the second layer in Table 8 was changed as shown in Table 14.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that any of the samples has an excellent durability and always brings about high quality visible images equivalent to initial visible images.

EXAMPLE 15

In Examples 8 through 14, except that there were practiced formation of electrostatic latent images and reversal development using GaAs series semiconductor laser (10 mW) rather than the tungsten lamp as the light source, the same image forming process as in Example 1 was employed for each of the light receiving members and the resulting transferred tonor images evaluated.

As a result, it was confirmed that any of the ligh receiving members always brings about high quality and highly resolved visible images with clearer half tone.

EXAMPLES 16 TO 20

In each example, the same procedures as in Example 1 were repeated, except using the layer forming conditions shown in Tables 15 to 19 respectively, to thereby obtain a light receiving member in drum form for use in electrophotography.

In each example, the gas flow ratio for $B_2H_6/SiH_4$ were controlled in accordance with the flow ratio curve shown in the following Table B.

The resulting light receiving members were subjected to the same copying test as in Example 1.

As a result, there were obtained high quality and highly resolved visible images for any of the light receiving members.

TABLE B

| Example No. | Number of the Figure for the gas flow ratio curve for $B_2H_6/SiH_4$ |
|---|---|
| 16 | 12 |
| 17 | 13 |
| 18 | 13 |
| 19 | 14 |
| 20 | 15 |

EXAMPLE 21

Light receiving members (sample Nos. 2101 to 2107) for use in electrophotography were prepared by the same procedures as in Example 1, except that the layer thickness was changed as shown in Table 20 in the case of forming the second layer (22) in Table 15.

The resulting light receiving members were respectively evaluated in accordance with the same image forming process as in Example 1.

The results were as shown in Table 20.

EXAMPLE 22

Light receiving members (sample Nos. 2201 to 2207) for use in electrophotography were prepared by the same procedures as in Example 1, except that the value relative to the flow ratio for $C_2H_4/SiH_4$ in the case of forming the second layer in Table 15 was changed as shown in Table 21.

The resulting light receiving members were respectively evaluated in accordance with the same procedures as in Example 1.

As a result, it was confirmed for each of the samples that high quality visible images with clearer half tones could be repeatedly obtained.

And, in the durability test upon repeating use, it was confirmed that any of the samples has an excellent durability and always brings about high quality visible images equivalent to initial visible images.

EXAMPLE 23

Light receiving members (sample Nos. 2301 to 2307) for use in electrophotography were prepared by the same procedures as in Example 1, except that the value relative to the flow ratio for $GeH_4/SiH_4$in the case of forming the first layer in Table 15 was changed as shown in Table 22.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that any of the samples has an excellent durability and always brings about high quality visible images equivalent to initial visible images.

EXAMPLE 24

In Examples 16 through 23, except that there were practiced formation of electrostatic latent images and reversal development using GaAs series semiconductor laser (10 mW) in stead of the tungsten lamp as the light source, the same image forming process as in Example 1 was employed for each of the light receiving members and the resulting transferred tonor images evaluated.

As a result, it was confirmed that any of the high receiving members always brings about high quality and highly resolved visible images with clearer half tone.

TABLE 1

| | | | (The gas flow rate being referred to FIG. 12) | | | | |
|---|---|---|---|---|---|---|---|
| Layer constitution | Layer preparing steps | Gas used | Flow amount (SCCM) | Flow ratio | Discharging power ($W/cm^2$) | Deposition speed (Å/sec) | Layer thickness (μ) |
| First layer | First step | $SiH_4/He = 1$<br>$B_2H_6/He = 1/100$ | $SiH_4 = 200$ | $B_2H_6/SiH_4 = 5/1000 \rightarrow 0$ | 0.18 | 8 | 4 |
| | Second step | $SiH_4/He = 1$ | $SiH_4 = 200$ | | 0.20 | 18 | 16 |

TABLE 1-continued (The gas flow rate being referred to FIG. 12)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/30000$ | 0.16 | 5 | 1 |

TABLE 2

(The gas flow rate being referred to FIG. 13)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$B_2H_6/He = 1/100$ | $SiH_4 = 200$ | $B_2H_6/SiH_4 = 5/1000 \rightarrow 3.75/1000$ | 0.18 | 8 | 4 |
| | Second step | $SiH_4/He = 1$<br>$B_2H_6/He = 1/100$ | $SiH_4 = 200$ | $B_2H_6/SiH_4 = 3.75/1000 \rightarrow 0$ | 0.20 | 18 | 12 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1130000$ | 0.16 | 5 | 1.5 |

TABLE 3

(The gas flow rate being referred to FIG. 13)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$B_2H_6/He = 1/100$ | $SiH_4 = 200$ | $B_2H_6/SiH_4 = 5/1000 \rightarrow 3.75/1000$ | 0.18 | 8 | 4 |
| | Second step | $SiH_4/He = 1$<br>$B_2H_6/He = 1/100$ | $SiH_4 = 200$ | $B_2H_6/SiH_4 \rightarrow 3.75/1000 \rightarrow 0$ | 0.20 | 18 | 12 |
| Second layer | Third step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) = 1/3000$ | 0.16 | 5 | 1.5 |

TABLE 4

(The gas flow rate being referred to FIG. 14)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$ | $SiH_4 = 200$ | | 0.18 | 8 | 2 |
| | Second step | $SiH_4/He = 1$ | $SiH_4 = 200$ | | 0.20 | 18 | 15 |
| | Third step | $SiH_4/He = 1$<br>$B_2H_6/He = 1/100$ | $SiH_4 = 200$ | $B_2H_6/SiH_4 = 0 \rightarrow 1/10000$ | 0.14 | 12 | 1 |
| Second layer | Forth step | $SiH_4/He = 0.5$<br>$C_2H_4$<br>$B_2/H_6He = 1/100$ | $SiH_4 = 200$ | $C_2H_4/SiH_4 = 3/10$<br>$B_2H_6/(SiH_4 = C_2H_4) = 1/10000$ | 0.16 | 5 | 1 |

TABLE 5

Figure 15:
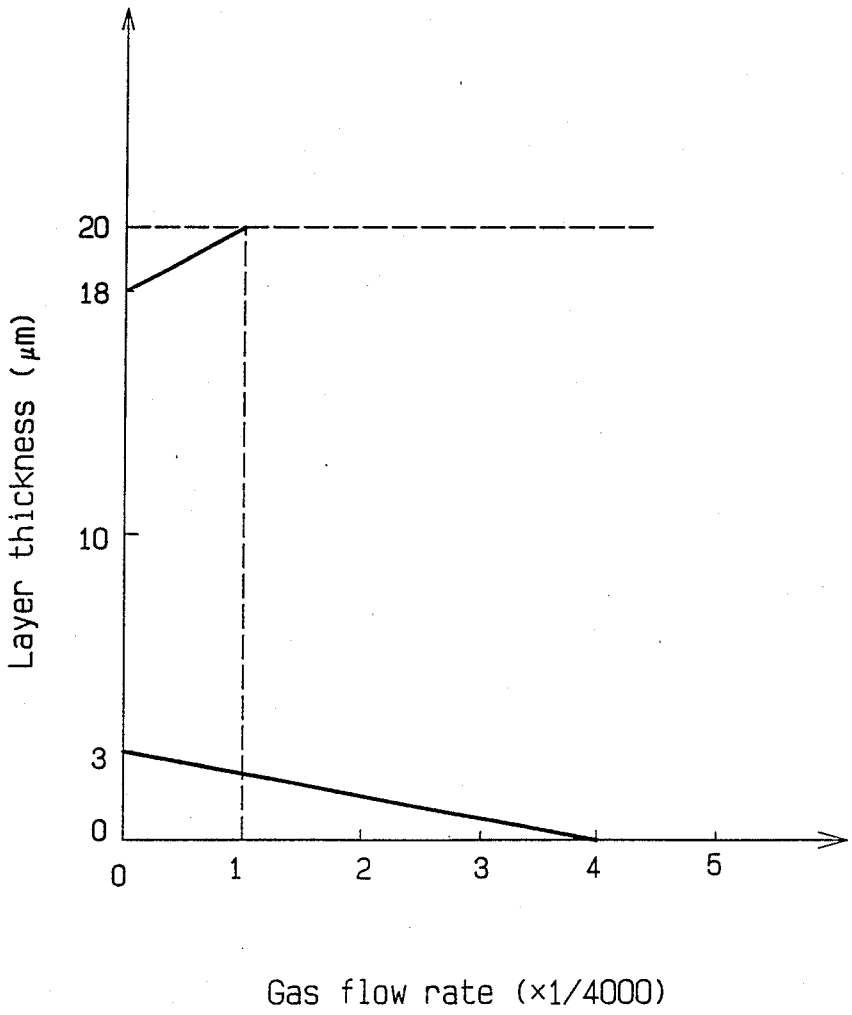

(The gas flow rate being referred to FIG. 15)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$B_2H_6/He = 1/100$ | $SiH_4 = 200$ | $B_2H_6/SiH_4 = 4/4000 \rightarrow 0$ | 0.18 | 9 | 3 |
| | Second step | $SiH_4/He = 1$ | $SiH_4 = 200$ | | 0.20 | 0.18 | 15 |
| | Third step | $SiH_4/He = 1$<br>$B_2H_6/He = 1/100$ | $SiH_4 = 200$ | $B_2H_6/SiH_4 = 0 \rightarrow 1/4000$ | 0.18 | 16 | 2 |
| Second layer | Forth step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 = C_2H_4) = 1/4000$ | 0.16 | 5 | 1 |

TABLE 6

| Sample No. | 601 | 602 | 603 | 604 | 605 | 606 | 607 |
|---|---|---|---|---|---|---|---|
| Thickness of the second layer (μ) | 0.1 | 0.5 | 1.5 | 2 | 3 | 4 | 5 |

TABLE 6-continued

TABLE 6-continued

| Sample No. | 601 | 602 | 603 | 604 | 605 | 606 | 607 |
|---|---|---|---|---|---|---|---|
| Evaluation | Δ | ○ | ⊙ | ⊙ | ○ | ○ | Δ |

: Excellent
: Good
Δ: Applicable for practical use

TABLE 7

| Sample No. | 701 | 702 | 703 | 704 | 705 | 706 | 707 |
|---|---|---|---|---|---|---|---|
| Gas flow ratio of $C_2H_4/SiH_4$ | 1/10 | 2/10 | 4/10 | 5/10 | 10/10 | 2/1 | 3/1 |
| Evaluation | ○ | ⊙ | ⊙ | ○ | ○ | ○ | Δ |

: Excellent
:Good
Δ: Applicable for practical use

TABLE 8

(The gas flow rate being referred to FIG. 12)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/HE = 1$<br>$GeH_4/He = 1$<br>$B_2H_6/He = 1/100$ | $SiH_4 = 200$ | $B_2H_6/SiH_4 = 5/1000 \rightarrow 0$<br>$GeH_4/SiH_4 = 1/50$ | 0.18 | 8 | 4 |
| | Second step | $SiH_4/He = 1$<br>$GeH_4/He = 1$ | $SiH_4 = 200$ | $GeH_4/SiH_4 = 1/50$ | 0.20 | 18 | 16 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/30000$ | 0.16 | 5 | 1 |

TABLE 9

(The gas flow rate being referred to FIG. 13)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$ | $SiH_4 = 200$ | $B_2H_6/SiH_4 = 5/1000 \rightarrow 3.75/1000$<br>$GeH_4/SiH_4 = 1/50$ | 0.18 | 8 | 4 |
| | Second step | $SiH_4/He = 1$<br>$GeH_4/He = 1$<br>$B_2H_6/He = 1/100$ | $SiH_4 = 200$ | $B_2H_6/SiH_4 = 3.75/1000 \rightarrow 0$<br>$GeH_4/SiH_4 = 1/50$ | 0.20 | 18 | 12 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/30000$ | 0.16 | 5 | 1.5 |

TABLE 10

(The gas flow rate being referred to FIG. 13)

| Layer constitution | Layer preparing steps | Gas used | Flow amount (SCCM) | Flow ratio | Discharge-ing power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$ | $SiH_4 = 200$ | $B_2H_6/SiH_4 = 5/1000 \rightarrow 3.75/1000$<br>$GeH_4/SiH_4 = 1/50$ | 0.18 | 8 | 4 |
| | Second step | $SiH_4/He = 1$<br>$GeH_4/He = 1$<br>$B_2H_6/He = 1/100$ | $SiH_4 = 200$ | $B_2H_6/SiH_4 = 3.75/1000 \rightarrow 0$<br>$GeH_4/SiH_4 = 1/50$ | 0.20 | 18 | 12 |
| Second layer | Third step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) = 1/3000$ | 0.16 | 5 | 1.5 |

TABLE 11

(The gas flow rate being referred to FIG. 14)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First Step | $SiH_4/He = 1$<br>$GeH_4/He = 1$ | $SiH_4 = 200$ | $GeH_4/SiH_4 = 1/50$ | 0.18 | 8 | 2 |
| | Second step | $SiH_4/He = 1$<br>$GeH_4/He = 1$ | $SiH_4 = 200$ | $GeH_4/SiH_4 = 1/50$ | 0.20 | 18 | 15 |
| | Third step | $SiH_4/He = 1$<br>$GeH_4/He = 1$<br>$B_2H_6/He = 1/100$ | $SiH_4 = 200$ | $B_2H_6/SiH_4 = 0 \rightarrow 1/10000$<br>$GeH_4/SiH_4 = 1/50$ | 0.14 | 12 | 1 |
| Second layer | Fourth step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) = 1/10000$ | 0.16 | 5 | 1 |

TABLE 12

(The gas flow rate being referred to FIG. 15)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$ | $SiH_4 = 200$ | $B_2H_6/SiH_4 = 4/4000 \rightarrow 0$<br>$GeH_4/SiH_4 = 1/50$ | 0.18 | 9 | 3 |
| | Second step | $SiH_4/He = 1$<br>$GeH_4/He = 1$ | $SiH_4 = 200$ | $GeH_4/SiH_4 = 1/50$ | 0.20 | 0.18 | 15 |
| | Third step | $SiH_4/He = 1$<br>$GeH_4/He = 1$<br>$B_2H_6/He = 1/100$ | $SiH_4 = 200$ | $B_2H_6/SiH_4 = 0 \rightarrow 1/4000$<br>$GeH_4/SiH_4 = 3/50$ | 0.18 | 16 | 2 |
| Second layer | Fourth step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) = 1/4000$ | 0.16 | 5 | 1 |

TABLE 13

| Sample No. | 1301 | 1302 | 1303 | 1304 | 1305 | 1306 | 1307 |
|---|---|---|---|---|---|---|---|
| Thickness of the second layer (μ) | 0.1 | 0.5 | 1.5 | 2 | 3 | 4 | 5 |
| Evaluation | Δ | ○ | ⊙ | ⊙ | ○ | ○ | Δ |

: Excellent
: Good
Δ: Applicable for practical use

TABLE 14

| Sample No. | 1401 | 1402 | 1403 | 1404 | 1405 | 1406 | 1407 |
|---|---|---|---|---|---|---|---|
| Gas flow ratio of $C_2H_4/SiH_4$ | 1/10 | 2/10 | 4/10 | 5/10 | 10/10 | 2/1 | 3/1 |
| Evaluation | ○ | ⊙ | ⊙ | ○ | ○ | ○ | Δ |

: Excellent
: Good
Δ: Applicable for practical use

TABLE 15

(The gas flow rate being referred to FIG. 12)

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$ | $SiH_4 = 200$ | $GeH_4/SiH_4 = 1/30$<br>$B_2H_6/SiH_4 = 5/1000 \rightarrow 0$ | 0.19 | 8 | 4 |
| | Second step | $SiH_4/He = 1$ | $SiH_4 = 200$ | | 0.20 | 18 | 16 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/30000$ | 0.16 | 5 | 1 |

TABLE 16

(The gas flow rate being referred to FIG. 13)

| Layer constitution | Layer preparing steps | Gas Used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$ | $SiH_4 = 200$ | $GeH_4/SiH_4 = 1/30$<br>$B_2H_6/SiH_4 = 5/1000 \rightarrow 3.75/1000$ | 0.19 | 8 | 4 |
| | Second step | $SiH_4/He = 1$<br>$B_2H_6/He = 1/100$ | $SiH_4 = 200$ | $B_2H_6/SiH_4 = 3.75/1000 \rightarrow 0$ | 0.20 | 18 | 12 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/30000$ | 0.16 | 5 | 1.5 |

TABLE 17

(The gas flow rate being referred to FIG. 13)

| Layer constitution | Layer preparing steps | Gas Used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$ | $SiH_4 = 200$ | $GeH_4/SiH_4 = 1/40$<br>$B_2H_6/SiH_4 = 5/1000 \rightarrow 3.75/1000$ | 0.19 | 7.5 | 4 |
| | Second step | $SiH_4/He = 1$<br>$B_2H_6/He = 1/100$ | $SiH_4 = 200$ | $B_2H_4/SiH_4 = 3.75/1000 \rightarrow 0$ | 0.20 | 18 | 12 |
| Second layer | Third step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) = 1/30000$ | 0.6 | 5 | 1.5 |

TABLE 18

(The gas flow rate being referred to FIG. 14)

| Layer constitution | Layer preparing steps | Gas Used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$ | $SiH_4 = 200$ | $GeH_4SiH_4 = 1/20$ | 0.18 | 7 | 2 |
| | Second step | $SiH_4/He = 1$ | $SiH_4 = 200$ | | 0.20 | 18 | 15 |
| | Third step | $SiH_4/He = 1$<br>$B_2H_6/He = 1/100$ | $SiH_4 = 200$ | $B_2H_6/SiH_4 = 0 \rightarrow 1/10000$ | 0.14 | 12 | 1 |
| Second layer | Fourth step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) = 1/10000$ | 0.16 | 5 | 1 |

TABLE 19

(The gas flow rate being referred to FIG. 15)

| Layer constitution | Layer preparing steps | Gas Used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$<br>$O_2/He = 0.5$ | $SiH_4 = 200$ | $B_2H_6/SiH_4 = 4/4000 \rightarrow 0$<br>$O_2/SiH_4 = 1/40 \rightarrow 0.25/40$<br>$GeH_4/SiH_4 = 1/40$ | 0.18 | 85 | 3 |
| | Second step | $SiH_4/He = 1$ | $SiH_4 = 200$ | | 0.20 | 0.18 | 15 |
| | Third step | $SiH_4/He = 1$<br>$B_2H_6/He = 1/100$ | $SiH_4 = 200$ | $B_2H_6/SiH_4 = 0 \rightarrow 1/4000$ | 0.18 | 16 | 2 |
| Second layer | Fourth step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) = 1/400$ | 0.16 | 5 | 1 |

TABLE 20

| Sample No. | 2101 | 2202 | 2103 | 2104 | 2105 | 2106 | 2107 |
|---|---|---|---|---|---|---|---|
| Thickness (μ) | 0.1 | 0.5 | 1.5 | 2 | 3 | 4 | 5 |
| Evaluation | Δ | ○ | ⊙ | ⊙ | ○ | ○ | Δ |

: Excellent
: Good
Δ: Applicable for practical use

TABLE 21

| Sample No. | 2201 | 2202 | 2203 | 2204 | 2205 | 2206 | 2207 |
|---|---|---|---|---|---|---|---|
| $C_2H_4/SiH_4$ Flow ratio | 1/10 | 2/10 | 4/10 | 5/10 | 10/10 | 2/1 | 3/1 |
| Evaluation | ○ | ⊙ | ⊙ | ○ | ○ | ○ | Δ |

: Excellent
: Good
Δ: Applicable for practical use

TABLE 22

| Sample No. | 2301 | 2302 | 2303 | 2304 | 2305 |
|---|---|---|---|---|---|
| Gas flow ratio of $GeH_4/SiH_4$ | 1/200 | 1/100 | 3/100 | 4/100 | 5/100 |
| Evaluation | ○ | ⊙ | ⊙ | ○ | Δ |

: Excellent
: Good
Δ: Applicable for practical use

What we claim is:

1. A light receiving member comprising a substrate for a light receiving member and a light receiving layer disposed on said substrate, said light receiving layer comprising (from the side of said substrate), a 1 to 100 μm thick first layer (I) having photoconductivity comprised of an amorphous material containing silicon atoms as the main constituent and at least one of hydrogen atoms and halogen atoms in a total amount of $10^{-2}$ to 40 atomic % and a $3\times10^{-3}$ to 30 μm thick second layer (II) comprised of an amorphous material containing silicon atoms, $10^{-3}$ to 90 atomic % of carbon atoms, and at least one of hydrogen atoms and halogen atoms in a total amount of $10^{-2}$ to 40 atomic %; said first layer (I) containing a conductivity controlling element in an unevenly distributed state in the layer thickness direction; and said second layer (II) containing a conductivity controlling element in a uniformly distributed state in the layer thickness direction.

2. A light receiving member according to claim 1, wherein the first layer (1) further contains germanium atoms in a uniformly distributed state in the layer thickness direction.

3. A light receiving member according to claim 1, wherein the first layer (I) further contains germanium atoms in partial layer region adjacent to the substrate in an unevenly distributed state in the layer thickness direction.

4. A light receiving member according to claim 1, wherein the conductivity controlling element contained in the first layer (I) is the same as the contained in the second layer (II).

5. A light receiving member according to claim 1, wherein the conductivity controlling element contained in the first layer (I) is different from that contained in the second layer (II).

6. A light receiving member according to claim 1, wherein the conductivity controlling element contained in the first layer (I) is a member selected from the group consisting of the group III and V elements of the periodic table.

7. A light receiving member according to claim 6, wherein the fist layer (I) contains the conductivity controlling element primarily in the partial layer region adjacent to the substrate in the layer thickness direction.

8. A light receiving member according to claim 6, wherein the first layer (I) contains the conductivity controlling element primarily in the partial layer region adjacent to the second layer (II) in the layer thickness direction.

9. A light receiving member according to claim 1, wherein the conductivity controlling element contained in the second layer (II) is a member selected from the group consisting of the group III and V elements of the periodic table.

10. A light receiving member according to claim 9, wherein the content of the conductivity controlling element in the second layer (II) is 1.0 to $10^4$ atomic ppm.

11. An electrophotographic process comprising the steps of:

(a) applying an electric field to the light receiving member of claim 1; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

On the title page, item [54]:

"A-SIC(HX)" should read --A-SIC(H,X)--.

On the title page, in item [57]:

Line 13, "an" should read --a--.

COLUMN 1

Line 4, "A-SIC(HX)" should read --A-SIC(H,X)--.
Line 45, "member" should read --members--.
Line 46, "A-Si materails" should read --A-Si materials--.

COLUMN 2

Line 13, "likely" should be deleted.
Line 15, "copies"" should read --copies")--.
Line 31, "carck" should read --crack--.
Line 42, "of" should be deleted.

COLUMN 3

Line 7, "Other" should read --Another--.
Line 20, "by" should read --from--.
Line 41, "FIGS. 12 through 13" should read --FIGS. 12 through 15--.
Line 52, "has" should read --have--.
Line 57, "composed A-Si" should read --composed of A-Si--.
Line 61, "This" should read --That--.
Line 62, "compose" should read --composed--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 4

Line 5, "two layer structure" should read --two-layer structure--.
Line 12, "A-Si(H,X)]," should read --A-Si(H,X)"],--.
Line 29, "an" should read --a--.
Line 30, "practical" should read --partial--.
Line 51, "periodical table" should read --periodic table--.
Line 54, "periodical table" should read --periodic table--.
Lines 61-62, "preferred. ¶ In" should read --preferred. In--.
Line 63, "contains" should read --contain--.

COLUMN 5

Line 40, "$SnO_2$ITO ($In_2O_3$+$SnO_2$)," should read --$SnO_2$, ITO ($In_2O_3$+$SnO_2$),--.
Line 54, "form" should read --form for--.
Line 56, "described" should read --desired--.

COLUMN 6

Line 6, "(herinafter," should read --(hereinafter,--.
Lines 9-10, "direction). ¶ The" should read --direction). The--.
Line 13, "depend" should read --depending--.
Line 21, "more" should read --most--.
Line 23, "Adversely" should read --Conversely--.
Line 24, "partical" should read --partial--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 6

Line 43, "amount the" should read --amount of the--.
Line 56, "In" should be deleted.
Line 59, "therefor" should read --thereof--.
Line 60, "decreased" should read --decreases--.

COLUMN 7

Line 8, after "in the range from" insert --position $t_B$ to position $t_1$ and thereafter gradually and continuously decreases--.
Line 29, "position $t_B$," should read --position $t_T$,--.
Line 33, "position B" should read --position $t_B$,--.
Line 34, "tion $C_8$" should read --tion $C_9$--.

COLUMN 8

Line 3, "membker" should read --member--.
Line 13, "an" should read --a--.
Line 30, "an" should read --a--.
Line 33, "an" should read --a--.
Line 35, "SiGe(H,X)"," should read --SiGe(H,X)"],--.

COLUMN 9

Line 1, "5 x" should read --5X--.
Line 3, "layer region" should read --layer region 102"--.
Line 12, "prerferably," should read --preferably,--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 9

Line 30, "first layer 103" should read --first layer 102--.
Line 48, "the case" should read --in the case--.
Line 68, "socalled" should read --so-called--.

COLUMN 10

Line 19, "on" should read --or-- and "takes" should read --changing--.
Line 41, "lay" should read --layer--.
Line 44, "bring" should read --brings--.

COLUMN 11

Line 3, "speical" should read --special--.
Line 17, "not give" should read --does not give--.
Line 19, "properties" should read --properties,--.
Line 21, "At" should read --And--.
Line 61, "SiH" should read --$SiH_4$ and $Si_2H_6$-- and italics should be deleted.
Line 62, Italics should be deleted.
Line 63, Italics should be deleted.

COLUMN 12

Lines 20-21, "substrate. ¶ For for" should read --substrate. For--.
Lines 23-24, "used. ¶ The" should read --used. The--.
Line 29, "Si" should read --$SiH_2Br_2$,--.
Line 30, "material" should read --materials--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 13

Line 9, "SiH" should read --$SiH_2Br_2$,--.
Line 31, "wth" should read --with--.
Line 41, "halogen atoms (H)" should read --halogen atoms (X)--.
Line 42, "caried" should read --carried--.
Line 55, "staring materials" should read --starting materials--.
Line 59, "A-SiGE(H,X)" should read --A-SiGe(H,X)--.
Line 67, "or a-SiGe(H,X)" should read --of A-SiGe(H,X)--.

COLUMN 14

Line 3, "A-SiGe(H,X)" should read --A-Si(H,X)--.
Line 11, "slicon target" should read --silicon target--.
Line 19, "silcon" should read --silicon--.
Line 41, "$Geh_2F_2$," should read --$GeH_2F_2$,--.
Line 42, "GeH-" should read -- $GeHI_3$, $GeH_2I_2$,--.
Line 53, "Si(H,X)" should read --Si(H,X) layer--.
Lines 55-56, "therein. ¶ Similarly layer" should read --therein. Similarly, a layer--.
Line 67, "tion" should read --tion,--.

COLUMN 15

Line 2, "phosphorous" should read --phosphorus--.
Line 4, "phosphorous" should read --phosphorus--.
Line 5, "phosphrus" should read --phosphorus--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 15

Line 7, "$ASBr_3$," should read --$AsBr_3$,-- and "$sbCl_5$," should read --$SbCl_5$,--.
Line 8, "$BiCl_{BiBr3}$" should read --$BiCl_3$, and $BiBr_3$-- and "to" should be deleted.
Line 19, "atoms]can" should read --atoms] can--.
Line 33, "glow discharing" should read --glow discharging--.
Line 54, "staring material" should read --starting material--.
Line 65, "staring material" should read --starting material--.

COLUMN 16

Line 4, "silicon hydrided" should read --silicon hydrides--.
Line 6, "well as" should read --as well as--.
Line 22, "of used" should read --be used--.
Line 40, "the sputter" should read --then sputtering--.
Line 41, "introducin" should read --introducing--.
Line 51, "halogen haloglen atoms" should read --and/or halogen atoms--.

COLUMN 17

Line 4, "stitued" should read --stituted--.
line 10, "50W/cm2," should read --$50W/cm^2$,--.
Line 11, "30W/cm2," should read --$30W/cm^2$,--.
Line 12, "20W/cm2." should read --$20W/cm^2$.--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 17

Line 21, "50W/cm2," should read --50W/cm$^2$,-- and "30W/cm2," should read --30W/cm$^2$,--.
Line 22, "20W/cm2." should read --20W/cm$^2$.--.
Line 27, "independnt" should read --independent--.
Line 48, "introducing into" should read --introducing the group III atoms or the group V atoms upon introducing into--.
Line 55, "in externally driving" should read --an externally driven--.

COLUMN 18

Line 19, "in" should be deleted.
Line 23, "(99.999%) purity," should read --(99.999% purity)--.
Line 27, ""$GeH_4$/He)" should read --"$GeH_4$/He")--.
Line 30, "to formed," should read --to be formed,--.
Line 31, "in stead" should read --instead--.
Line 34, "126" should read --1126--.
Line 37, "133" should read --1133--.
Line 40, "vacuum" should read --vacuum gauge--.
Line 45, "vacuum" should read --vacuum gauge--.
Line 50, "AL cylinder" should read --Al cylinder--.
Line 52, "$B_2H_6$/$H_6$ gas" should read --$B_2H_6$/He gas--.
Line 56, "1 kg/cm2." should read --1 kg/cm$^2$.-- and "values" should read --valves--.
Line 57, "subvalves 1132" should read --subvalves 1132 and 1133--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 19

Line 15, "micro-computer" should read --microcomputer--.
Line 22, "vaccum" should read --vacuum--.
Line 45, "a" should read --an--.
Line 66, "14 abnd 15" should read --14 and 15--.

COLUMN 20

Line 17, "(samples NOs. 701 to 707)" should read --(Sample Nos. 701 to 707)--.

COLUMN 21

Line 27, "tonor images" should read --toner images--.
Line 28, "ligh" should read --light--.

COLUMN 22

Line 20, "half tones" should read --half tone--.
Line 31, "$GeH_4/SiH_4$in" should read --$GeH_4/SiH_4$ in--.
Line 49, "in stead" should read --instead--.
Line 52, "tonor images" should read --toner images--.
Line 53, "high" should read --light--.

COLUMN 23

TABLE 2, "$PH_3/(SiH_4 + C_2H_4)$ = 1130000" should read --$PH_3/(SiH_4 + C_2H_4)$ = 1/30000--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 23

TABLE 4, "$B_2/H_6He$ = 1/100" should read --$B_2H_6/He$ = 1/100--. and

"$B_2H_6/(SiH_4 = C_2H_4)$ = 1/10000" should read

--$B_2H_6/(SiH_4 + C_2H_4)$ = 1/10000--.

TABLE 5, "$B_2H_6/(SiH_4 = C_2H_4)$ = 1/4000" should read

--$B_2H_6/(SiH_4 + C_2H_4)$ = 1/4000--.

COLUMN 25

TABLE 6-continued, ":Excellent :Good" should read --⊙:Excellent ○:Good--.

TABLE 8, "$SiH_4/HE$ = 1" should read --$SiH_4/He$ = 1--.

COLUMN 26

TABLE 7, ":Excellent :Good" should read --⊙:Excellent ○:Good--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 27

TABLE 13, ":Excellent :Good" should read --⊙:Excellent ○:Good--.

COLUMN 28

TABLE 14, ":Excellent :Good" should read --⊙:Excellent ○:Good--.

TABLE 17, " Discharg- ing power ($W/cm^2$) 0.19 0.20 0.6 " should read -- Discharg- ing power ($W/cm^2$) 0.19 0.20 0.16 --.

COLUMN 29

TABLE 18, "$GeH_4SiH_4$ = 1/20" should read --$GeH_4/SiH_4$ = 1/20--.

TABLE 20, "2202" should read --2102-- and

":Excellent :Good" should read --⊙:Excellent ○:Good--.

UNITED STATES PATENT AND TRADEMARK OFFICE

CERTIFICATE OF CORRECTION

PATENT NO. : 4,818,652

DATED : April 4, 1989

INVENTOR(S) : SHIGERU SHIRAI, ET AL.

It is certified that error appears in the above-identified patent and that said Letters Patent is hereby corrected as shown below:

COLUMN 29

| | | |
|---|---|---|
| TABLE 21, ":Excellent :Good" | should read | --◎:Excellent ○:Good--. |
| TABLE 22, ":Excellent :Good" | should read | --◎:Excellent ○:Good--. |

COLUMN 30

Line 39, "first layer (1)" should read --first layer (I)--.
Line 49, "the contained" should read --that contained--.
Line 61, "fist layer (I)" should read --first layer (I)--.

Signed and Sealed this

Fifth Day of May, 1992

*Attest:*

DOUGLAS B. COMER

*Attesting Officer*

*Acting Commissioner of Patents and Trademarks*